US009637959B2

(12) United States Patent
Marsden et al.

(10) Patent No.: US 9,637,959 B2
(45) Date of Patent: May 2, 2017

(54) SECURITY GATE LATCH SYSTEM

(71) Applicant: Dorel Juvenile Group, Inc., Foxboro, MA (US)

(72) Inventors: Andrew W Marsden, Hingham, MA (US); Raul G Pereira, Cumberland, RI (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/513,780

(22) Filed: Oct. 14, 2014

(65) Prior Publication Data

US 2015/0101253 A1 Apr. 16, 2015

Related U.S. Application Data

(60) Provisional application No. 61/889,806, filed on Oct. 11, 2013.

(51) Int. Cl.

| | |
|---|---|
| ***E06B 9/02*** | (2006.01) |
| ***E05C 19/00*** | (2006.01) |
| ***E06B 9/04*** | (2006.01) |
| ***E05B 63/00*** | (2006.01) |
| ***E05B 65/00*** | (2006.01) |
| ***E05B 65/06*** | (2006.01) |
| ***E05C 1/08*** | (2006.01) |
| *E06B 9/00* | (2006.01) |

(52) U.S. Cl.

CPC ..... *E05C 19/003* (2013.01); *E05B 63/0065* (2013.01); *E05B 65/0007* (2013.01); *E05B 65/0014* (2013.01); *E05B 65/06* (2013.01); *E05C 1/08* (2013.01); *E06B 9/04* (2013.01); *E06B 2009/002* (2013.01)

(58) Field of Classification Search

CPC .... E05B 65/0014; E05B 65/0007; E06B 9/00; E06B 2009/002; E05C 19/003

USPC ..... 49/55, 57, 50, 394, 463; 292/16, 44, 49, 292/52, 54, 70, 74, 194, 238, 202, 203, 292/207, 230, 234, 341.15, 341.17, 137, 292/138, 340, 288, 298, 256

See application file for complete search history.

(56) References Cited

U.S. PATENT DOCUMENTS

| | | | | | |
|---|---|---|---|---|---|
| 1,264,084 | A | * | 4/1918 | Jungemann | E05C 3/124 292/227 |
| 1,264,244 | A | * | 4/1918 | Woiwod | E05B 85/24 292/255 |
| 1,510,993 | A | * | 10/1924 | Houser | E05B 65/06 292/341.17 |
| 2,538,668 | A | * | 1/1951 | Chrisman | E05B 65/0007 292/54 |
| 2,809,063 | A | * | 10/1957 | Taylor | E05B 65/06 292/218 |
| 4,083,591 | A | * | 4/1978 | Parisien | E05B 65/06 292/202 |
| 4,831,777 | A | | 5/1989 | Johnson, Jr. | |
| 5,711,554 | A | * | 1/1998 | Brown | E05B 65/0014 292/17 |
| 5,809,694 | A | | 9/1998 | Postans | |
| 6,016,629 | A | | 1/2000 | Sylvester | |
| 6,027,104 | A | | 2/2000 | Alexander et al. | |

(Continued)

*Primary Examiner* — Justin Rephann

(74) *Attorney, Agent, or Firm* — Barnes & Thornburg LLP

(57) ABSTRACT

A gate is mounted to pivot about a pivot axis between opened and closed positions. A latch is provided to retain the gate in a doorway-closing position in a doorway formed in a door frame.

17 Claims, 6 Drawing Sheets

(56) References Cited

U.S. PATENT DOCUMENTS 6,112,460 A 9/2000 Wagnitz
6,176,042 B1 * 1/2001 Rossman ..... A01K 1/0017 160/210
6,178,694 B1 1/2001 Wagnitz
6,233,874 B1 5/2001 Johnson, Jr.
6,536,163 B1 3/2003 Monahan et al.
6,536,502 B2 3/2003 Monahan et al.
6,711,857 B1 3/2004 Wagnitz et al.
7,065,922 B1 * 6/2006 De Kruijf ..... E05B 65/0014 292/212
7,178,792 B2 2/2007 Monahan et al.
7,334,624 B2 2/2008 Waldman
7,540,046 B1 * 6/2009 Lai ..... A47D 13/065 256/26
7,565,769 B2 7/2009 Monahan et al.
7,874,103 B2 1/2011 Yates
7,878,558 B1 * 2/2011 Bell ..... E05B 15/022 292/163
7,963,575 B2 * 6/2011 Mayo ..... E05B 65/0007 160/225
8,341,886 B2 * 1/2013 Yates ..... E05B 65/0007 204/468
8,607,502 B2 * 12/2013 Flannery ..... E06B 9/04 292/170
8,615,928 B2 * 12/2013 Wang ..... E04H 17/00 49/226
2003/0009945 A1 * 1/2003 Cheng ..... E05F 1/063 49/57
2004/0045222 A1 * 3/2004 Hicks ..... E05F 1/066 49/394
2005/0028947 A1 * 2/2005 Waldman ..... E05B 17/2053 160/215
2006/0081826 A1 * 4/2006 Cheng ..... E06B 9/04 256/22
2006/0175028 A1 * 8/2006 Askinasi ..... E05B 65/0014 160/225
2006/0207180 A1 * 9/2006 Cheng ..... E05C 1/06 49/57
2007/0131921 A1 * 6/2007 Monahan ..... E06B 9/04 256/73
2010/0293861 A1 * 11/2010 Ting ..... E05B 47/026 49/394
2012/0011775 A1 * 1/2012 Chen ..... E05B 47/004 49/358
2012/0255234 A1 * 10/2012 Wang ..... E05B 65/0007 49/395
2013/0086840 A1 * 4/2013 Marsden ..... E05B 41/00 49/13
2014/0007506 A1 * 1/2014 Huang ..... E06B 3/32 49/149

* cited by examiner

SECURITY GATE LATCH SYSTEM

PRIORITY CLAIM

This application claims priority under 35 U.S.C. §119(e) to U.S. Provisional Application Ser. No. 61/889,806, filed Oct. 11, 2013, which is expressly incorporated by reference herein.

BACKGROUND

The present disclosure relates to movable barriers, and particularly to security gates. More particularly, the present disclosure relates to latches and swing-direction controllers in a swinging security gate unit for use in a doorway.

SUMMARY

A gate unit in accordance with the present disclosure includes a gate that can be moved in a doorway about a pivot axis by a person between closed and opened positions. In the closed position, the gate is arranged to block movement through the doorway.

In illustrative embodiments, the gate unit includes a gate mount that is adapted to mate with a door frame bordering a doorway. The gate is mounted for swinging movement between opened and closed positions about a vertical pivot axis on upper and lower hinges included in a gate-pivot support portion of the gate mount that is coupled to a first door jamb included in the door frame.

In illustrative embodiments, the swinging gate includes a barrier wall, an upper latch pin coupled to an upper portion of the barrier wall, and a lower latch pin coupled to a lower portion of the barrier wall and arranged to lie below the upper latch pin. The upper latch pin is configured to mate with an upper latch included in a gate-motion blocker portion of the gate mount that is coupled to an opposing second door jamb included in the door frame upon arrival of the swinging gate at the closed position. The lower latch pin is configured to mate with a lower latch included in the gate-motion blocker portion of the gate mount that is coupled to the second door jamb.

In illustrative embodiments, each of the upper and lower latches includes a spring-biased gate retainer that is mounted for up-and-down movement in a channel formed in the host latch to intercept a companion latch pin as the swinging gate arrives at the closed position. The spring-biased movable gate retainer is formed to include a pin-receiver notch sized to receive and retain a free end of a companion latch pin upon arrival of the swinging gate at the closed position. Cam ramps are provided on the spring-biased gate retainer in each of the upper and lower latches on either side of each pin-receiver notch and arranged to intercept the free end of a companion latch pin of a swinging gate as the gate approaches the closed position to provide means for compressing an underlying spring to move the gate retainer downwardly against the spring to allow the latch pin to travel on the cam ramp and then snap into the pin-receiver notch during upward spring-driven movement of the spring-biased gate retainer to a normal position to block further swinging movement of the gate about the pivot axis and retain the gate in the closed position. Each spring-biased gate retainer includes a clockwise-motion cam ramp arranged to face in one direction to intercept a companion latch pin of a gate swinging in a clockwise direction about the pivot axis toward a closed position and a counterclockwise-motion cam ramp arranged to face in an opposite direction to intercept a companion latch pin of a gate swinging in a counterclockwise direction about the pivot axis toward a closed position.

In illustrative embodiments, the gate unit further includes a bidirectional swing stop that is coupled to the lower latch and arranged to block rotation of the swinging gate about the vertical pivot axis in either a counterclockwise direction or a clockwise direction at the option of a caregiver. The swing stop can be positioned on the lower latch by the caregiver to lie in a first orientation on the lower latch to intercept the lower latch pin of a gate swinging in a clockwise direction toward a closed position to block continued swinging motion of the gate in the clockwise direction past the closed position. Alternatively, the swing stop can be positioned by the caregiver to lie in a second orientation on the lower latch to intercept the lower latch pin of a gate swinging in a counterclockwise direction toward a closed position to block continued swinging motion of the gate in the counterclockwise direction past the closed position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
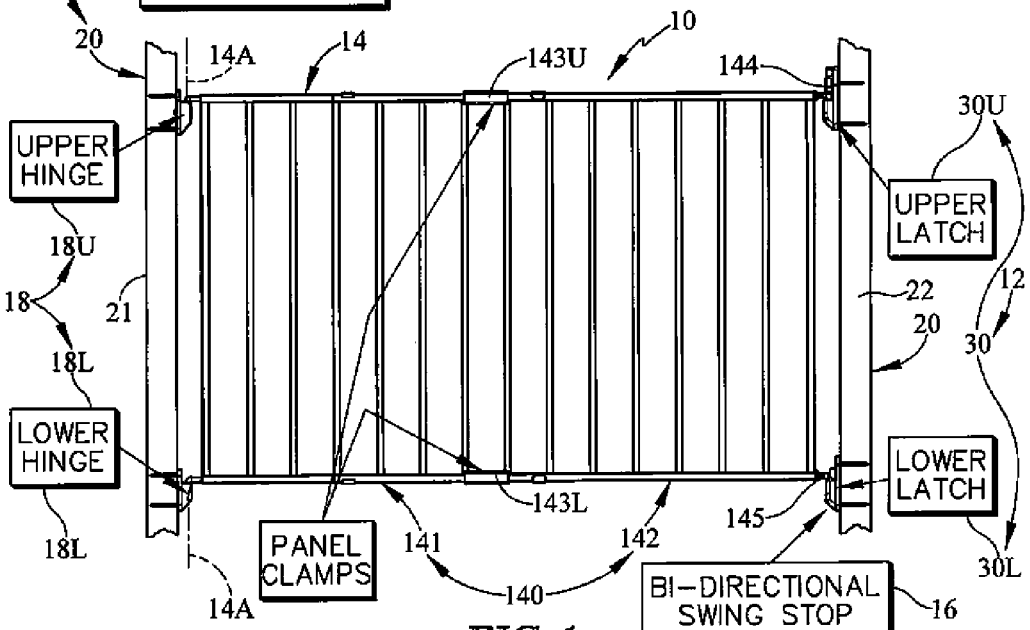
FIG. 1 is a front elevation view of a gate unit in accordance with the present disclosure showing that the gate unit includes a swinging gate including a barrier wall defined by two overlapping panels held together by upper and lower panel clamps, an upper latch (gate lock) pin coupled to an upper right corner of the barrier wall, and a lower latch (gate lock) pin coupled to a lower right corner of the barrier wall and showing that the gate unit includes a gate mount including a gate-pivot support adapted to be coupled to a first door jamb included in a door frame and configured to include upper and lower hinges, a gate-motion blocker adapted to be coupled to an opposing second door jamb included in a door frame and configured to include an upper latch arranged to mate with the upper latch pin upon arrival of the swinging gate at a closed position and a lower latch arranged to mate with the lower latch pin upon arrival of the swinging gate at a closed position, and a bidirectional swing stop coupled to the lower latch in an orientation selected to limit swinging movement of gate past the closed position in either a clockwise direction or a counterclockwise direction.

Gate unit 10 includes a gate mount 12 that is adapted to mate with opposing first and second door jambs 21, 22 of door frame 20 and a swinging gate 14 that is mounted to swing about a vertical pivot axis 14A between opened and closed positions as suggested in FIG. 1. Gate unit 10 also includes a bidirectional swing stop 16 coupled to gate mount 12 and configured to block overtravel of swinging gate 14 past a closed position.

Figure 2:
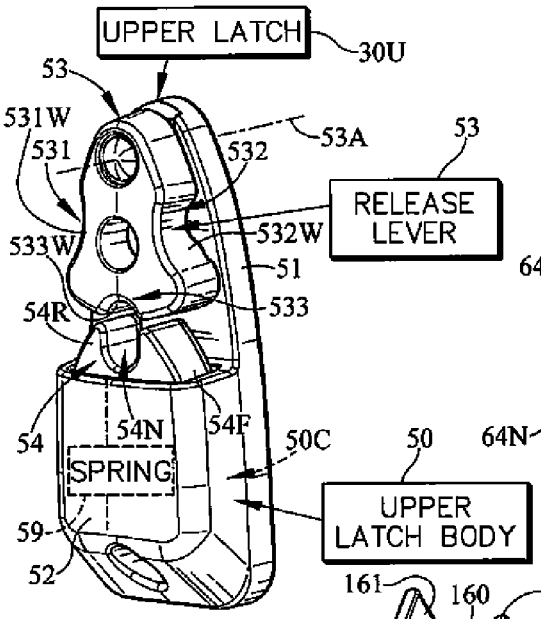
FIG. 2 is an enlarged perspective view of the upper latch of FIG. 1.
Figure 3:
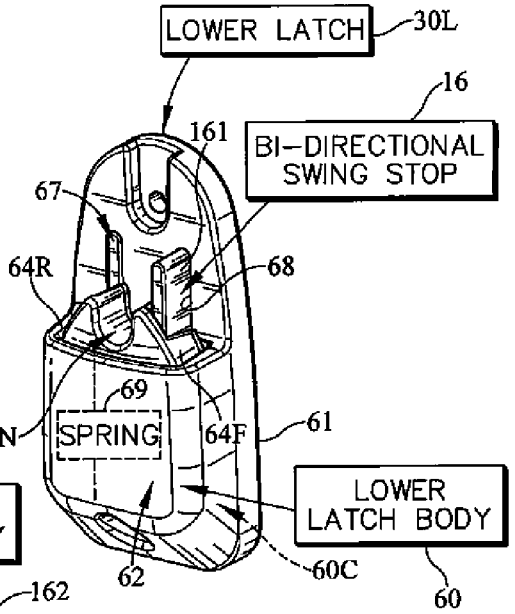
FIG. 3 is an enlarged perspective view of the lower latch of FIG. 1 and showing the bidirectional swing stop positioned to lie in one of the two available orientations on the lower latch to control the direction of gate swing about the vertical pivot axis beyond the closed position in a clockwise direction.
Figure 4:
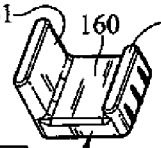
FIG. 4 is an enlarged perspective view of the bidirectional swing stop of FIG. 3 showing that the swing stop includes a back plate, a long motion-blocker lug coupled to a left edge of the back plate, and a relatively short stop-retainer lug coupled to the right edge of the back plate.

Gate mount 12 includes a gate-pivot support 18 coupled to first door jamb 21 and configured to include upper and lower hinges 18U, 18L and a gate-motion blocker 30 coupled to second door jamb 22 and configured to include separate upper and lower latches 30U, 30L as suggested in FIGS. 1-3. Each latch 30U, 30L is made in accordance with the present disclosure to engage a latch pin 144 or 145 included in gate 14 to retain the swinging gate 14 in the closed position upon arrival of the swinging gate at the closed position and to release the latch pin 144 or 145 under the control of and at the direction of a caregiver to allow the closed gate to swing to an opened position.

Figure 6B:
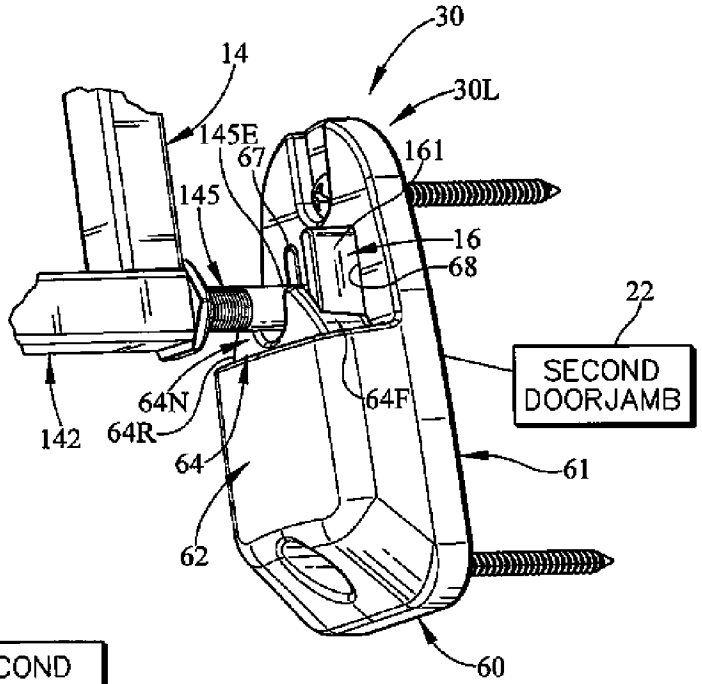
FIG. 6B is a perspective view of the components shown in FIG. 6A from a different point of view.
Figure 6A:
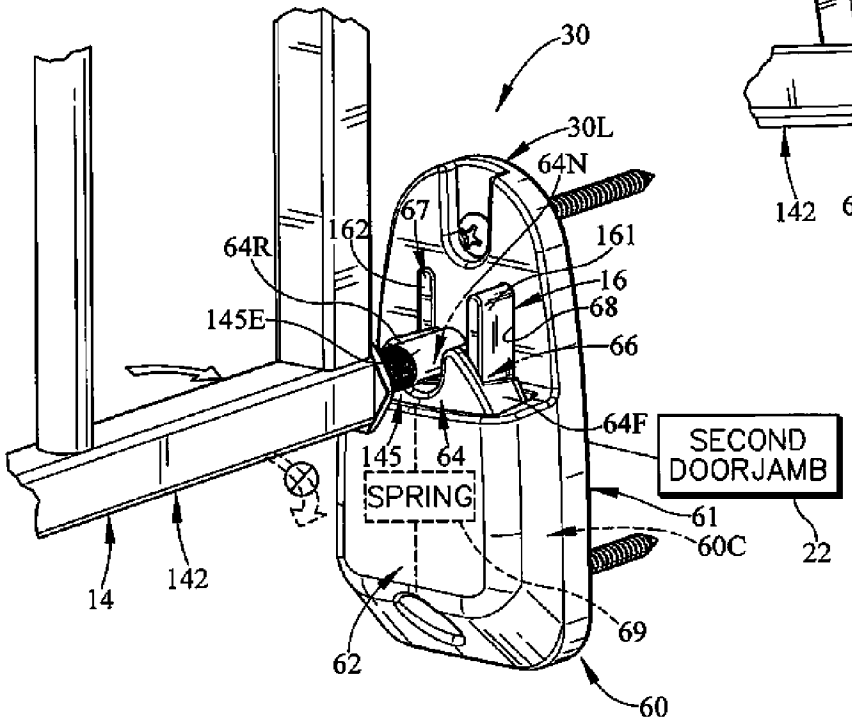
FIG. 6A is an enlarged perspective view of a lower portion of the gate unit of FIG. 1 showing a free end of the lower latch pin mounted on the lower right corner of the barrier wall extending into a pin-receiver notch formed in a spring-biased gate retainer of the lower latch upon arrival of the clockwise swinging gate of FIG. 1 at the closed position to help retain the gate in the closed position and showing placement of the bidirectional swing stop in a first orientation on the lower latch to position the long motion-blocker lug on a front side of the lower latch to block further swinging of the gate past the closed position in the clockwise direction so that overtravel of the swinging gate past the closed position is blocked.
Figure 8:
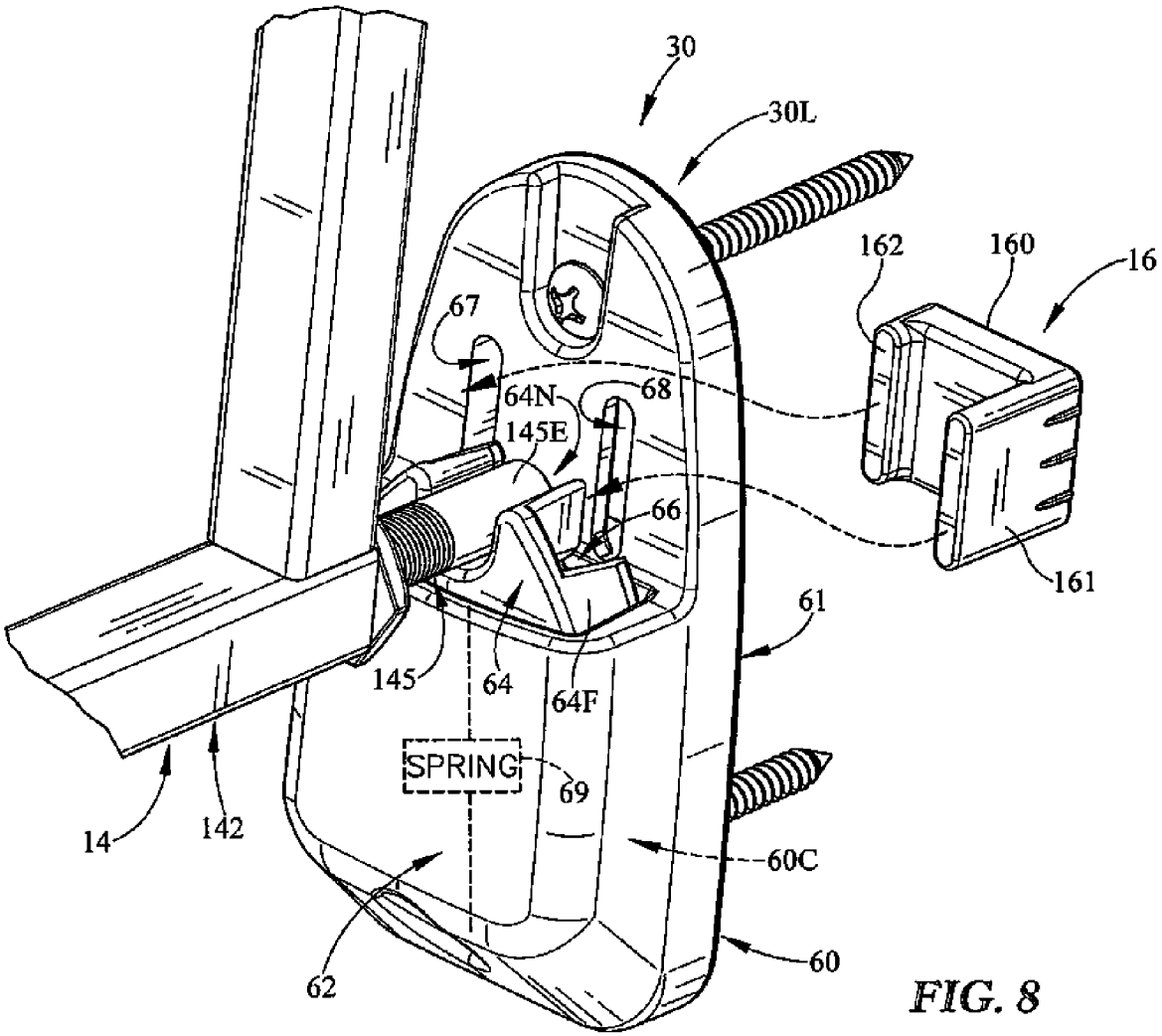
FIG. 8 is an enlarged view similar to FIG. 7.
Figure 9:
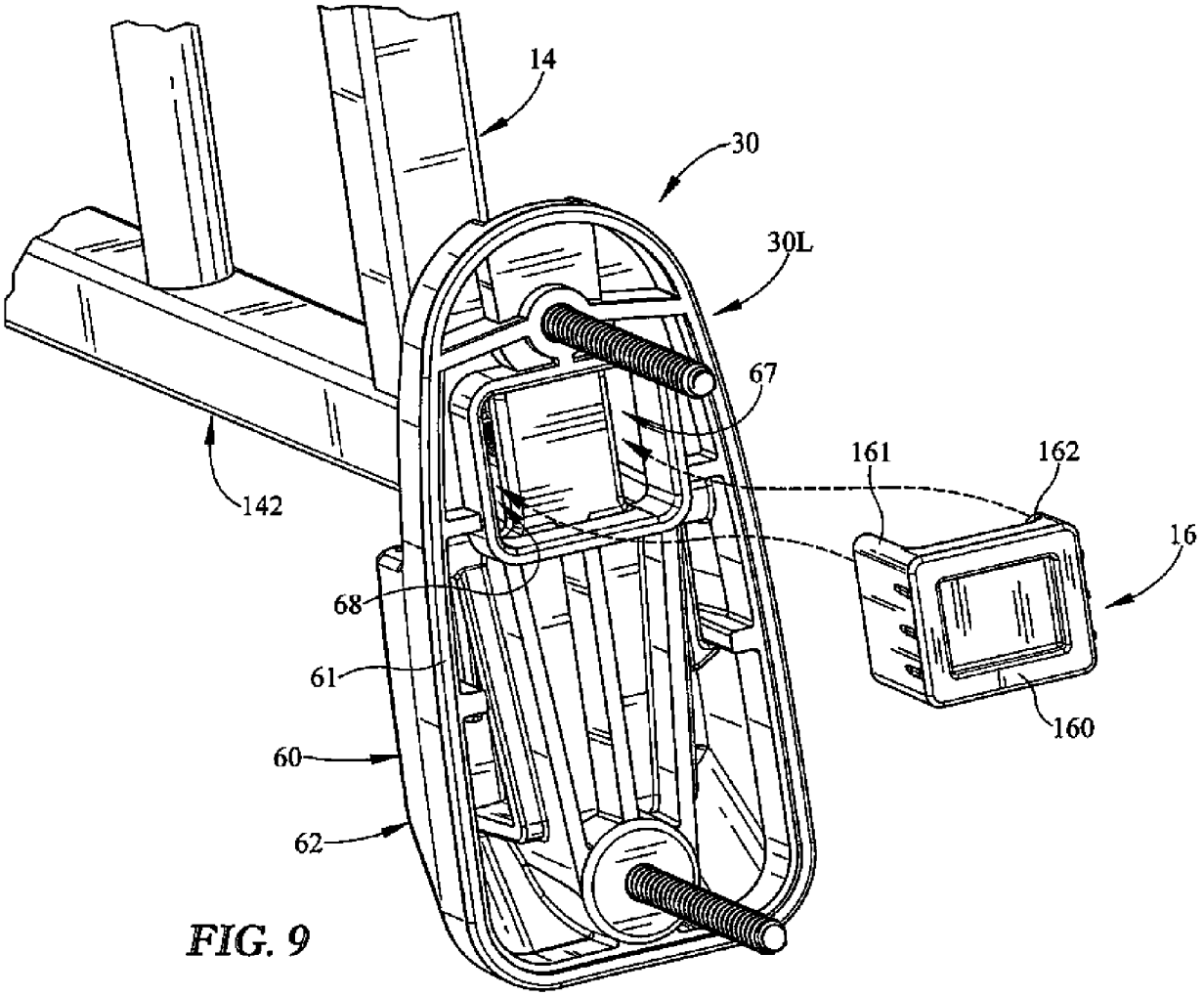
FIG. 9 is another view of the components shown in FIGS. 7 and 8 from another point of view.

Gate-motion blocker 30 also includes a bidirectional swing stop 16 coupled to lower latch 30L as suggested in FIGS. 1 and 6A. Bidirectional swing stop 16 can be mounted by a caregiver in the field in a first orientation on lower latch 30L to block clockwise-swing overtravel of gate 14 as suggested in FIGS. 3, 6A, and 7. Bidirectional swing stop 16 can also be mounted by the caregiver in the field in a reversed second orientation as suggested in phantom in FIG. 7 on lower latch 30L to block counterclockwise-swing overtravel of gate 14. The caregiver can change the orientation of the bidirectional swing stop 16 in the field once lower latch 30L is separated from the second door jamb 22 so that the caregiver can gain access to the bidirectional swing stop 16 as suggested in FIGS. 7-9.

Gate 14 includes a barrier wall 140 defined by overlapping left-side and right-side panels 141, 142 in an illustrative embodiment shown in FIG. 1. Gate 14 also includes upper and lower panel clamps 143U, 143L coupled to panels 141, 142 to anchor right-side panel 142 in a fixed position relative to left-side panel 141 to establish the width of barrier wall 140. The width of barrier wall 140 can be varied by changing the relative positions of left-side and right-side panels 141, 142. Upper hinge 18U is coupled to an upper left corner of left-side panel 141 and lower hinge 18L is coupled to a lower left corner of left-side panel 141 to support left-side panel 141 (and the right-side panel 142 clamped to left-side panel 141) for swinging movement about vertical pivot axis 14A when gate 14 is not coupled to upper and lower latches 30U, 30L of gate-motion blocker support 30 of gate mount 12. Left-side panel 141 of barrier wall 140 is also free to slide up and down on hinges 18U, 18L along vertical pivot axis 14A during unlocking of gate 14 by a caregiver to allow swinging movement of the gate 14 from the closed position to the opened position. It is within the scope of the present disclosure to use a single panel to form barrier wall 140.

Figure 5:
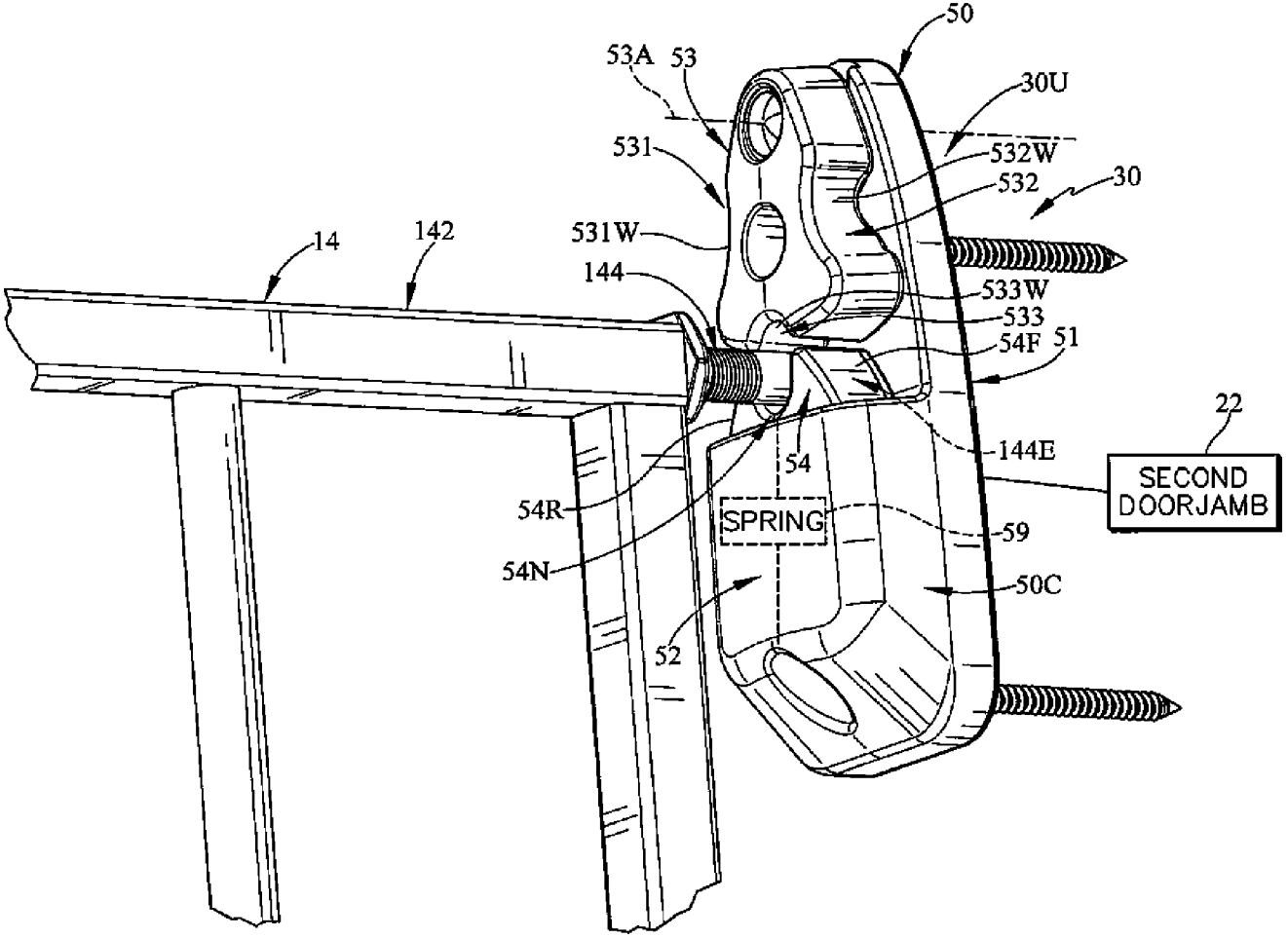
FIG. 5 is an enlarged perspective view of a portion of the gate unit of FIG. 1 showing a free end of the upper latch pin mounted on the upper right corner of the barrier wall extending into a pin-receiver notch formed in a spring-biased gate retainer of the upper latch upon arrival of the swinging gate of FIG. 1 at the closed position to help retain the gate in the closed position.

Gate 14 also includes an upper latch pin 144 coupled to an upper right corner of right-side panel 142 as shown, for example, in FIGS. 1 and 5. A free end 144E of upper latch pin 144 is arranged to extend into a companion pin-receiver notch 54N formed in a spring-biased movable gate retainer 54 included in upper latch 30U of gate-motion blocker 30 of gate mount 12 to retain swinging gate 14 in a closed position as suggested in FIGS. 1, 2, and 5.

Gate 14 also includes a lower latch pin 145 coupled to a lower right corner of right-side panel 142 as shown, for example, in FIGS. 1 and 6A. A free end 145E of lower latch pin 145 is arranged to extend into a companion pin-receiver notch 64N formed in a spring-biased movable gate retainer 64 included in lower latch 30L of gate-motion blocker 30 of gate mount 12 to retain swinging gate 14 in a closed position as suggested in FIG. 1.

An illustrative upper latch 30U is shown in FIG. 2. Upper latch 30U includes a body 50, a pin-release lever 53, spring-biased movable gate retainer 54, and a retainer-biasing spring 59. Body 50 includes a mounting plate 51 and a gate-retainer support 52 coupled to a lower portion of mounting plate 51. Spring-biased movable gate retainer 54 is formed to include pin-receiver notch 54N and mounted for up-and-down movement in gate-retainer support 52 to lie under the rotatable pin-release lever 53 as suggested in FIG. 2. Retainer-biasing spring 59 is arranged to act against the body 50 and the movable gate retainer 54 and underlie gate retainer 54 normally to urge gate retainer 54 to move relative to body 50 from a lowered position retracted within a retainer-receiver chamber 50C formed in body 50 to a raised position extending partly beyond body 50 as shown, for example, in FIG. 2. Pin-release lever 53 is mounted on an upper portion of mounting plate 51 for manual rotation about an axis of rotation 53A by a caregiver to free latch pin 144 to be removed from pin-receiver notch 54N when the caregiver wishes to unlock gate 14 as suggested in FIG. 5.

Spring-biased movable gate retainer 54 of upper latch 30U includes a rear cam ramp 54R and a front cam ramp 54F arranged to lie in spaced-apart relation to rear cam ramp 54R to form pin-receiver notch 54N therebetween. Each cam ramp 54R, 54F is inclined to move gate retainer 54 downwardly against an upwardly directed biasing force generated by the underlying retainer-biasing spring 59 to guide the upper latch pin 144 of swinging gate 14 into the pin-receiver notch 54N formed in the movable gate retainer 54 during swinging movement of gate 14 about vertical pivot axis 14A toward the closed position. Rear cam ramp 54R has a positive slope and front cam ramp 54F has a negative slope in illustrative embodiments.

Pin-release lever 53 is formed to include an outwardly opening shallow pin-retention channel 533 and flanking outwardly opening first and second broad and deep lost-motion pin-release channels 531, 532 as shown, for example, in FIGS. 2 and 5. Upper latch pin 144 is unable to exit pin-receiver notch 54N when pin-release lever 53 is rotated to a locked position shown in FIGS. 1 and 5 to cause a shallow interior wall 533W defining the shallow pin-retention channel 533 to be arranged to confront a top aperture opening into the pin-receiver notch 54N. To allow the upper latch pin 144 to exit pin-receiver notch 54N to free gate 14 to be pivoted from the closed position to an opened position, a caregiver must rotate pin-release lever 53 about axis of rotation 53A to an unlocked position to place either (1) a deep interior wall 531W defining broad and deep lost-motion pin-release channel 531 or (2) a deep interior wall 532W defining broad and deep lost-motion pin-release channel 532 in confronting relation to the top aperture opening into pin-receiver notch 54N. Then the caregiver can lift gate 14 upwardly on hinges 18U, 18L to move upper latch pin 144 out of pin-receiver notch 54N to clear the spring-biased movable gate retainer 54 of upper latch 30U and subsequently lower gate 14 downwardly on hinges 18U, 18L to allow free-swinging movement of gate 14 about vertical pivot axis 14A.

An illustrative lower latch 30L is shown in FIG. 3. Lower latch 30L includes a body 60, a spring-biased movable gate retainer 64, and a retainer-biasing spring 69. Body 60 includes a mounting plate 61 and a gate-retainer support 62 coupled to a lower portion of mounting plate 61. Spring-biased movable gate retainer 64 is formed to include a pin-receiver notch 64N and mounted for up-and-down movement in gate-retainer support 62. Retainer-biasing spring 69 is arranged to act against body 60 and the movable gate retainer 64 normally to urge gate retainer 64F to move relative to body 60 from a lowered position retracted within a retainer-receiver chamber 60C formed in body 60 to a raised position extending partly beyond body 60 as shown, for example, in FIG. 3.

Figure 7:
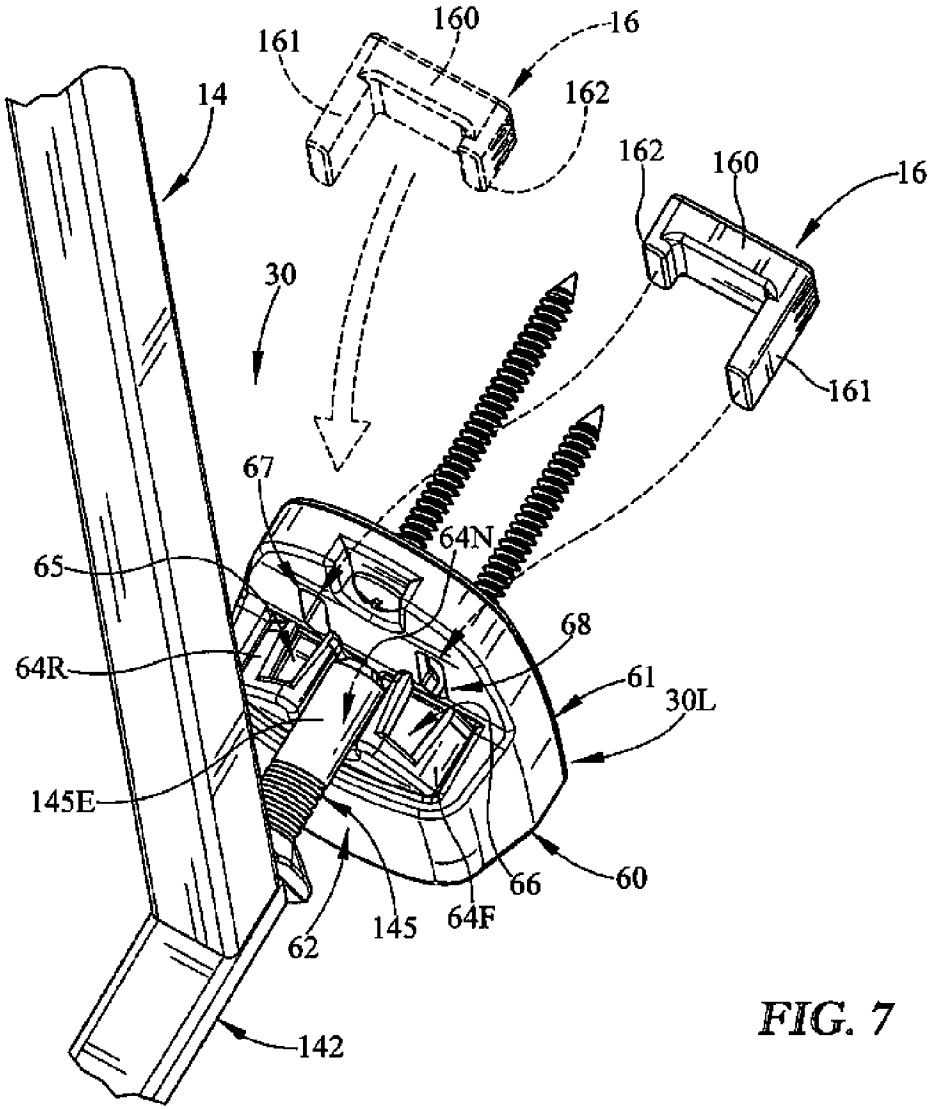
FIG. 7 is a view similar to FIG. 6A showing the bidirectional swing stop (in solid) before it is mounted on the lower latch by a caregiver to assume a first orientation on the lower latch as shown in FIG. 6A and showing that the lower latch includes a vertical mounting plate formed to include rear (left) and front (right) lug-transfer slots and adjacent front and rear lug-receiving channels, each sized to receive the free end of the motion-blocker lug and showing an alternative orientation (in phantom) of the bidirectional swing stop.

Spring-biased movable gate retainer 64 is formed to include a rear cam ramp 64R, a front cam ramp 64F, and a pin-receiver notch 64N formed between cam ramps 64R, 64F, as suggested in FIGS. 6A and 7. Pin-receiver notch 64N is sized to receive latch pin 145 therein when gate 14 is closed as suggested in FIGS. 6A and 6B.

Each cam ramp 64R, 64F is inclined to move gate retainer 64 downwardly against an upwardly directed biasing force generated by an underlying spring 69 to guide the lower latch pin 145 of swinging gate 14 into the pin-receiver notch 64N during swinging movement of gate 14 about vertical pivot axis 14A toward the closed position. Rear cam ramp 64R has a positive slope and front cam ramp 64F has a negative slope in illustrative embodiments.

Bidirectional swing stop 16 is included in gate-motion blocker 30 and is configured to be coupled to lower latch 30L by a caregiver in a first orientation shown in FIGS. 3, 6A, and 6B to block clockwise-swing overtravel of gate 14. Bidirectional swing stop 16 can also be coupled to lower latch 30L in a reversed second orientation to block counterclockwise-swing overtravel of gate 14 as suggested in phantom in FIG. 7. Various channels and slots are formed in lower latch 30L to allow coupling of bidirectional swing stop 16 to lower latch 30L in each of the two orientations. As shown in FIG. 7, lower latch 30L also is formed to include a rear lug-receiving channel 65 in rear cam ramp 64R and a front lug-receiving channel 66 in front cam ramp 64F and these channels 65, 66 are sized and located to receive lugs 161, 162 included in bidirectional swing stop 16. Mounting plate 61 is formed to include a rear lug-transfer slot 67 opening into rear lug-receiving channel 65 and a front lug-transfer slot 68 lying in spaced-apart relation to rear lug-transfer slot 67 and opening into front lug-receiving channel 66 as shown in FIG. 7 and these slots 67, 68 are also sized and located to receive lugs 161, 162 included in bidirectional swing stop 16.

Bidirectional swing stop 16 is configured to be mounted in two different orientations on lower latch 30U as suggested in FIG. 7. The orientation will be selected by a caregiver to establish the swing direction of the gate 14 about vertical pivot axis 16A. Bidirectional swing stop 16 includes a back plate 160, a long motion-blocker lug 161 coupled to one edge of back plate 160, and a relatively short stop-retainer lug 162 coupled to another edge of back plate 160 as shown, for example, in FIGS. 3 and 7. In a first orientation, long motion-blocker lug 161 extends through front lug-transfer slot 68 into front lug-receiving channel 66 and stop-retainer lug 162 extends into rear lug-transfer slot 67 (without extending into rear lug-receiving channel 65) while back plate 160 mates with mounting plate 161 so that clockwise-swing overtravel of gate 14 is blocked. In a second orientation, long motion-blocker lug 161 extends through rear lug-transfer slot 67 into rear lug-receiving channel 65 and stop-retainer lug 162 extends into front lug-transfer slot 68 (without extending into front lug-receiving channel 66) so that counterclockwise-swing overtravel of gate 14 is blocked.

A gate unit 10 in accordance with the present disclosure includes a gate 14 that can be moved in a doorway about a vertical pivot axis 14A by a person between closed and opened positions. In the closed position, the gate 14 is arranged to block movement through the doorway as suggested in FIG. 1.

In illustrative embodiments, gate unit 10 includes a gate mount 12 that is adapted to mate with a door frame 20 bordering a doorway. Gate 14 is mounted for swinging movement between opened and closed positions about vertical pivot axis 14A on upper and lower hinges 18U, 18L included in a gate-pivot support portion of gate mount 12 that is coupled to a first door jamb 21 included in door frame 20.

In illustrative embodiments, swinging gate 14 includes a barrier wall 140, an upper latch pin 144 coupled to an upper portion of barrier wall 140, and a lower latch pin 145 coupled to a lower portion of barrier wall 140 and arranged to lie below upper latch pin 144. Upper latch pin 144 is configured to mate with an upper latch 30U included in a gate motion-blocker portion of gate mount 12 that is coupled to an opposing second door jamb 22 included in door frame 20 upon arrival of swinging gate 14 at the closed position. Lower latch pin 145 is configured to mate with a lower latch 30L included in the gate motion-blocker portion of the gate mount 12 that is coupled to second door jamb 22.

In illustrative embodiments, upper latch 30U is formed to include a pin-receiver notch 54N sized to receive and retain a free end of a companion latch pin 144 upon arrival of the swinging gate 14 at the closed position. Cam ramps 54R, 54F are provided in upper latch 30U on either side of pin-receiver notch 54N and arranged to intercept the free end of a latch pin 144 of a swinging gate 14 as the gate 14 approaches the closed position to provide means for pushing the spring-biased gate retainer 54 downwardly in a companion retainer-receiver channel 50C formed in gate-retainer support 52 against retainer-biasing spring 59 and for guiding the free end of a latch pin 144 into a companion pin-receiver notch 54N formed in spring-biased gate retainer 54 to block further swinging movement of the gate 14 about the vertical pivot axis 14A and retain the gate 14 in the closed position. Upper latch 30U includes a clockwise-motion cam ramp 54R arranged to face in one direction to intercept latch pin 144 of gate 14 swinging in a clockwise direction about vertical pivot axis 14A toward a closed position and a counterclockwise-motion cam ramp 54F arranged to face in an opposite direction to intercept latch pin 144 of gate 14 swinging in a counterclockwise direction about pivot axis 14A toward a closed position.

In illustrative embodiments, lower latch 30L is formed to include a pin-receiver notch 64N sized to receive and retain a free end of a companion latch pin 145 upon arrival of the swinging gate 14 at the closed position. Cam ramps 64R, 64F are provided in the lower latch 30L on either side of pin-receiver notch 64N and arranged to intercept the free end of a latch pin 145 of a swinging gate 14 as the gate 14 approaches the closed position to provide means for pushing the spring-biased gate retainer 64 downwardly in a companion retainer-receiving channel formed in gate-retainer support 62 against retainer-biasing spring 69 and for guiding the free end of latch pin 145 into a companion pin-receiver notch 64N formed in spring-biased gate retainer 64 to block further swinging movement of gate 14 about pivot axis 14A and retain gate 14 in the closed position. Lower latch 30L includes a clockwise-motion cam ramp 64R arranged to face in one direction to intercept a latch pin 145 of a gate 14 swinging in a clockwise direction about the vertical pivot axis 14A toward a closed position and a counterclockwise-motion cam ramp 64F arranged to face in an opposite direction to intercept a latch pin 145 of gate 14 swinging in a counterclockwise direction about the vertical pivot axis 14A toward a closed position.

In illustrative embodiments, gate unit 10 further includes a bidirectional swing stop 16 that is coupled to lower latch 30L and arranged to block rotation of swinging gate 14 about vertical pivot axis 14A in either a counterclockwise direction or a clockwise direction at the option of a caregiver. It is desired to use swing stop 16 to minimize motion of a swinging gate over stairs in a stairwell. The bidirectional swing stop 16 can be positioned on lower latch 30L by the caregiver to lie in a first orientation on the lower latch 30L to intercept lower latch pin 145 of a gate 14 swinging in a clockwise direction toward a closed position to block continued swinging motion of gate 14 in the clockwise direction past the closed position. Alternatively, the bidirectional swing stop 16 can be positioned by the caregiver to lie in a second orientation on lower latch 30L to intercept the lower latch pin 145 of a gate 14 swinging in a counterclockwise direction toward a closed position to block continued swinging motion of gate 14 in the counterclockwise direction past the closed position.

A latch mechanism 30U, 30L is provided in gate mount 12 in accordance with the present disclosure is configured for ease of use by a consumer to allow swinging gate 14 to lock in place when gate 14 is swung shut without the need for the consumer to lift the gate 14 into the locked position. Gate unit 10 is provided with a redundant release action by means of upper and lower latches 30U, 30L to minimize risk of unauthorized opening of gate 14. Lower latch 30L is configured to accept a bidirectional swing stop 16 to allow a consumer to control the swing direction of gate 14. Bidirectional swing stop 16 is installed from the back side as suggested in FIG. 9 and is entrapped once lower latch 30L is mounted on second door jamb 22 of door frame 20.

During a normal opening operation of gate 14, a user grasps a portion of barrier wall 140 while rotating pin-release lever 53 of upper latch 30U about axis of rotation 53A to place either of pin-retention channels 531, 532 in confronting relation to pin-receiver notch 54N to free the trapped latch pin 144 so that it can exit pin-receiver notch 54N. With pin-release lever 53 rotated out of the way, the consumer can lift gate 14 in an upward direction and then swing gate 14 away from upper and lower latches 30U, 30L to disengage upper latch pin 144 from upper latch 30U and to disengage lower latch pin 145 from lower latch 30L.

To close the gate 14, the consumer swings gate 14 about pivot axis 14A toward the closed position. Each latch pin 144, 145 rides on a companion cam ramp in upper or lower latch 30U, 30L to move spring-biased gate retainer 54 or 64 downwardly to compress a spring 59 or 69 housed in gate-retainer support 52 or 62 to allow each latch pin 144, 145 to move into its companion pin-receiver notch 54N, 64N. Then each mover-lift spring 59 or 69 exerts an upward force to move spring-biased gate retainer 54 or 64 upwardly to retain latch pin 144 in pin-receiver notch 54N and latch pin 145 in pin-receiver notch 64N to lock gate 14 in the closed position.

The invention claimed is:

1. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, and wherein the body is formed to include a retainer-receiver chamber and the movable gate retainer is located to position the pin-receiver notch in the retainer-receiver chamber when the movable gate retainer occupies the lowered position to discharge the latch pin from the pin-receiver notch.

2. The gate unit of claim 1, wherein the movable gate retainer includes a rear cam ramp arranged to face in a rearward direction and a front cam ramp arranged to lie in spaced-apart relation to the rear cam ramp and face in an opposite forward direction to locate the pin-receiver notch therebetween, the rear cam ramp is arranged to intercept and engage the latch pin during swinging movement of the barrier wall about the gate pivot axis from an opened position toward the closed position and inclined to move the movable gate retainer downwardly relative to the body against an upwardly directed biasing force second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, wherein the movable gate retainer includes a rear cam ramp arranged to face in a rearward direction and a front cam ramp arranged to lie in spaced-apart relation to the rear cam ramp and face in an opposite forward direction to locate the pin-receiver notch therebetween, the rear cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the clockwise direction toward the closed position, and the front cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the counterclockwise direction toward the closed position, and wherein the body is formed to include a retainer-receiver chamber containing the retainer-biasing spring, a lower portion of the movable gate retainer engages the retainer-biasing spring and remains in the retainer-receiver chamber in both of the lowered and raised positions of the movable gate retainer, and an upper portion of the movable gate is formed to include the rear and front cam faces and is arranged to lie outside the retainer-receiver chamber formed in the body upon movement of the barrier wall to assume the closed position to locate each of the generated by the retainer-biasing spring to guide the latch pin into the pin-receiver notch formed in the movable gate retainer during swinging movement of the barrier wall of the gate about the vertical pivot axis in the clockwise direction toward the closed position, and the front cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the counterclockwise direction toward the closed position.

3. The gate unit of claim 2, wherein the movable gate retainer includes an upwardly opening U-shaped interior wall arranged to define a boundary of the pin-receiver notch and configured to include a curved bottom wall section arranged to mate with the latch pin upon movement of the barrier wall of the gate to assume the closed position, a rear side wall section arranged to interconnect the curved bottom wall and the rear cam ramp, and a front side wall section arranged to lie in spaced-apart parallel relation to the rear side wall and interconnect the curved bottom wall and the front cam face.

4. The gate unit of claim 2, wherein the latch includes a pin-release lever formed to include an outwardly opening shallow pin-retention channel and a flanking outwardly opening first relatively deep lost-motion pin-release channel, the shallow pin-retention channel is arranged to confront a top aperture opening into the pin-receiver notch when the pin-release lever is rotated to assume the locked position to cause a shallow interior wall of the pin-release lever arranged to define the shallow pin-retention channel to block exit of the latch pin from the pin-receiver notch, and the relatively deep lost-motion pin-release channel is arranged to confront the top aperture opening into the pin-receiver notch when the pin-release lever is rotated to assume the unlocked position to cause a deep interior wall defining the first relatively deep lost-motion pin-release channel to lie in spaced-apart relation to the top aperture opening into the pin-receiver notch to allow the latch pin to exit the pin-receiver notch to free the gate to be pivoted from the closed position to an opened position in response to upward movement of the gate relative to the door frame.

5. The gate of claim 2, wherein the gate-motion blocker further includes a bidirectional swing stop coupled to the latch and arranged to lie in a first orientation on the latch to block clockwise-swing overtravel of the gate swinging in a clockwise direction about the vertical pivot axis from an opened position past the closed position and arranged to lie in a reversed second orientation on the latch to block counterclockwise-swing overtravel of the gate swinging in a counterclockwise direction about the vertical pivot axis from an opened position past the closed position.

6. The gate of claim 1, wherein the gate-motion blocker further includes a bidirectional swing stop coupled to the latch and arranged to lie in a first orientation on the latch to block clockwise-swing overtravel of the gate swinging in a clockwise direction about the vertical pivot axis from an opened position past the closed position and arranged to lie in a reversed second orientation on the latch to block counterclockwise-swing overtravel of the gate swinging in a counterclockwise direction about the vertical pivot axis from an opened position past the closed position.

7. The gate unit of claim 1, wherein the gate-motion blocker further includes bidirectional swing-stop means for blocking overtravel of the swinging barrier wall of the gate about the vertical pivot axis past the closed position and wherein the bidirectional swing-stop means is coupled to the body of the latch in a first orientation to block clockwise-swing overtravel and to the body of the latch in a second orientation to block counterclockwise-swing overtravel.

8. The gate unit of claim 1, wherein the retainer-biasing spring is located in the body.

9. The gate unit of claim 1, wherein the retainer-biasing spring is arranged to lie below the pin-receiver notch.

10. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the rear and front cam faces outside of the retainer-receiver chamber and to lie at least partly inside the retainer-receiver chamber formed in the body during engagement of the latch pin of the gate and one of the rear and front cam faces as the barrier wall is moved about the gate pivot axis from an opened position toward the closed position.

11. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a Rate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the Rate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, wherein the movable gate retainer includes a rear cam ramp arranged to face in a rearward direction and a front cam ramp arranged to lie in spaced-apart relation to the rear cam ramp and face in an opposite forward direction to locate the pin-receiver notch therebetween, the rear cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the clockwise direction toward the closed position, and the front cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the counterclockwise direction toward the closed position, and wherein the gate-pivot support is coupled to the barrier wall of the gate to allow up-and-down movement of the barrier wall relative to the gate-pivot support along the gate pivot axis at the option of a caregiver while the barrier wall is retained in the closed position, the body includes a mounting plate adapted to be mounted on the second doorjamb and a gate-retainer support coupled to the mounting plate and formed to include a retainer-receiver chamber containing the retainer-biasing spring and receiving the movable gate retainer therein, and the latch further includes a pin-release lever that is mounted on an upper portion of the mounting plate to lie in spaced-apart relation to the gate-retainer support to locate the rear and front cam ramps of the movable gate retainer therebetween when the movable gate retainer is urged by the retainer-biasing spring to assume the raised position, the pin-release lever is formed to include an outwardly opening shallow pin-retention channel and flanking outwardly opening relatively deep first and second lost-motion pin-release channels, and a shallow interior wall included in the pin-release lever to define the shallow pin-retention channel is arranged to lie in close proximity to the latch pin located in the pin-receiver notch formed in the movable gate retainer upon rotation of the pin-release lever about an axis of rotation to a locked position to cause the pin-release lever and the movable gate retainer to cooperate to provide means for retaining the latch pin in the pin-receiver notch so that the barrier wall of the gate is retained in the closed position, and a deep interior wall included in the pin-release lever to define the deep first lost-motion pin-release channel is arranged to lie in spaced-apart relation to the latch pin located in the pin-receiver notch formed in the movable gate retainer upon rotation of the pin-release lever about the axis of rotation to an unlocked position to define pin-exit means for defining an exit path along which the latch pin may move to exit the pin-receiver notch in response to upward movement of the barrier wall along the gate pivot axis to lift the latch pin out of the pin-receiver notch formed in the movable gate retainer without downward movement of the movable gate retainer to compress the spring so that the barrier wall of the gate is free to be pivoted about the gate pivot axis to an opened position.

12. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, wherein the movable gate retainer includes a rear cam ramp arranged to face in a rearward direction and a front cam ramp arranged to lie in spaced-apart relation to the rear cam ramp and face in an opposite forward direction to locate the pin-receiver notch therebetween, the rear cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the clockwise direction toward the closed position, and the front cam ramp is arranged to intercept and engage the latch pin during swinging movement of the barrier wall about the gate pivot axis from an opened position toward the closed position and inclined to move the movable gate retainer downwardly relative to the body against an upwardly directed biasing force generated by the retainer-biasing spring to guide the latch pin into the pin-receiver notch formed in the movable gate retainer during swinging movement of the barrier wall of the gate about the vertical pivot axis in the counterclockwise direction toward the closed position, and wherein the rear cam ramp is formed to include a rear lug-receiving channel, the front cam ramp is formed to include a front lug-receiving channel, the body is formed to include a rear lug-transfer slot opening into the rear lug-receiving channel and a front lug-transfer slot opening into the front lug-receiving channel, the bidirectional swing stop includes a back plate, a long motion-blocker lug coupled to the back plate, and a relatively short stop-retainer lug coupled to the back plate and arranged to lie in spaced-apart relation to the long motion-blocker lug, and wherein, in the first orientation of the bidirectional swing stop on the latch, the long motion-blocker lug extends through the front lug-transfer slot formed in the body into the front lug-receiving channel formed in the front cam ramp to intercept the latch pin during swinging movement of the barrier wall of the gate in a clockwise direction toward the closed position to block continued swinging movement of the gate in the clockwise direction past the closed position so that clockwise-swing overtravel is blocked while the relatively shorter stop-retainer lug extends into the rear lug-transfer slot without extending into the rear lug-receiving channel and wherein, in the second orientation, the long motion-blocker lug extends through the rear lug-transfer slot into the rear lug-receiving channel to intercept the latch pin during swinging movement of the barrier wall of the gate in a counterclockwise direction toward the closed position to block continued swinging movement of the gate in the counterclockwise direction past the closed position so that counterclockwise-swing overtravel is blocked while the stop-retainer lug extends into the front lug-transfer slot without extending into the front lug-receiving channel.

13. The gate of claim 12, wherein the body includes a mounting plate adapted to be mounted on the second doorjamb of the door frame and a gate-retainer support coupled to the mounting plate and formed to include a retainer-receiver chamber containing the retainer-biasing spring and receiving the movable gate retainer and the mounting plate is formed to include the front and rear lug-transfer slots.

14. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, and wherein the latch includes a clockwise-motion cam ramp and a counterclockwise-motion cam ramp arranged to lie in spaced-apart relation to the clockwise-motion cam ramp to locate the pin-receiver notch therebetween, each cam ramp is arranged to intercept a free end of the latch pin as the barrier wall approaches the closed position to provide means for pushing the spring-biased movable gate retainer downwardly in a companion retainer-receiver channel formed in the body against the retainer-biasing spring and for guiding the free end of the latch pin into the pin-receiver notch formed in the spring-biased movable gate retainer to block further swinging movement of the barrier wall of the gate about the vertical pivot axis and retain the barrier wall in the closed position and wherein the clockwise-motion cam ramp is arranged to face in one direction to intercept the latch pin during swinging movement of the barrier wall in a clockwise direction about the vertical pivot axis and the counterclockwise-cam ramp is arranged to face in an opposite direction to intercept the latch pin during swinging movement of the barrier wall in a counterclockwise direction about the vertical pivot axis.

15. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move upwardly relative to the body from a lowered position discharging the latch pin from the pin-receiver notch to free the barrier wall to swing about the vertical pivot axis to a raised position receiving and retaining the latch pin in the pin-receiver notch in response to swinging movement of the barrier wall about the vertical pivot axis to assume the closed position to block any further swinging movement of the barrier wall about the vertical pivot axis to retain the barrier wall in the closed position, and wherein the movable gate retainer is mounted for up-and-down movement in a channel formed in the latch to intercept the latch pin as the barrier wall of the swinging gate arrives at the closed position, cam ramps are provided on the movable gate retainer on either side of the pin-receiver notch and arranged to intercept a free end of the latch pin as the barrier wall of the gate approaches the closed position to provide means for compressing the retainer-biasing spring to move the spring-biased movable gate retainer downwardly against the retainer-biasing spring to allow the latch pin to travel on one of the cam ramps and then snap into the pin-receiver notch during upward spring-driven movement of the movable gate retainer to a normal position to block further swinging movement of the barrier wall of the gate about the vertical pivot axis and retain the barrier wall of the gate in the closed position, and the movable gate retainer includes a clockwise-motion cam ramp arranged to face in one direction to intercept the latch pin of the gate swinging in a clockwise direction about the vertical pivot axis toward the closed position and a counterclockwise-motion cam ramp arranged to face in an opposite direction to intercept the latch pin of the gate swinging in a counterclockwise direction about the vertical pivot axis toward the closed position.

16. The gate unit of claim 15, wherein the gate-motion blocker further includes a bidirectional swing stop that is coupled to the latch and arranged to block rotation of the swinging barrier wall of the gate about the vertical pivot axis in one of a counterclockwise direction and a clockwise direction at the option of a caregiver, the bidirectional swing stop is positioned on the latch by the caregiver to lie in a first orientation on the latch to intercept the latch pin of a gate swinging in a clockwise direction toward a closed position to block continued swinging motion of the gate in the clockwise direction past the closed position, and, alternatively, the bidirectional swing stop is positioned by the caregiver to lie in a second orientation on the latch to intercept the latch pin of a gate swinging in a counterclockwise direction toward a closed position to block continued swinging motion of the gate in the counterclockwise direction past the closed position.

17. A gate unit comprising a gate including a barrier wall and a latch pin mounted in a stationary position on the barrier wall to move therewith and arranged to extend in a horizontal direction away from the barrier wall and a gate mount adapted to mate with a door frame bordering a doorway, the gate mount including a gate-pivot support adapted to be coupled to a first doorjamb of the door frame and arranged to support the barrier wall of the gate for swinging movement in one of a clockwise direction and a counterclockwise direction about a vertical pivot axis between opened and closed positions, the gate mount further including a gate-motion blocker adapted to be coupled to an opposite second doorjamb of the door frame and arranged to mate with the latch pin included in the gate to block swinging movement of the barrier wall of the gate about the vertical pivot axis, wherein the gate-motion blocker comprises a latch including a body adapted to be coupled to the second doorjamb, a movable gate retainer formed to include a pin-receiver notch sized to receive a portion of the latch pin upon movement of the barrier wall to assume the closed position, a retainer-biasing spring arranged to yieldably urge the movable gate retainer to move relative to the body from a lowered position to a raised position receiving the latch pin in the pin-receiver notch in response to swinging movement of the barrier wall about the vertical pivot axis to assume the closed position to block any further swinging movement of the barrier wall about the vertical pivot axis to retain the barrier wall in the closed position, cam means included in the movable gate retainer for intercepting the latch pin during swinging movement of the barrier wall of the gate and moving the movable gate retainer to the lower position to guide the latch pin into the pin-receiver notch to block further swinging movement of the gate about the vertical pivot axis and retain the gate in the closed position, and wherein the body is formed to include a retainer-receiver chamber and the movable gate retainer is located to position the pin-receiver notch in the retainer-receiver chamber when the movable gate retainer occupies the lowered position to discharge the latch pin from the pin-receiver notch.

* * * * *